US006212717B1

(12) United States Patent
Cooper

(10) Patent No.: US 6,212,717 B1
(45) **Date of Patent: *Apr. 10, 2001**

(54) ARTICLES WITH GRIPPING SURFACES

(75) Inventor: Robert W. Cooper, Barrington, RI (US)

(73) Assignee: Klear-Vu Corporation, Fall River, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/241,163

(22) Filed: Feb. 1, 1999

Related U.S. Application Data

(63) Continuation-in-part of application No. 08/993,602, filed on Dec. 18, 1997, now Pat. No. 5,896,603.

(51) Int. Cl.[7] ..... A47C 27/00

(52) U.S. Cl. ..... 5/653; 5/925; 297/228.11; 108/90

(58) Field of Search ..... 5/411, 653, 654, 5/925; 108/90; 297/219.1, 224, 218.4, 228.11; 428/134, 136

(56) References Cited

U.S. PATENT DOCUMENTS

| | | | | |
|---|---|---|---|---|
| D. 360,794 | | 8/1995 | Morin . | |
| 2,156,629 | | 5/1939 | Hutchinson | 5/925 X |
| 2,483,223 | | 9/1949 | Moss | 297/228.11 |
| 2,546,109 | | 11/1951 | Puchalsky . | |
| 3,242,507 | | 3/1966 | Peterson | 5/411 X |
| 3,637,454 | | 1/1972 | Pavernick | 161/144 |
| 3,829,914 | | 8/1974 | Treat | 5/925 X |
| 3,916,447 | | 11/1975 | Thompson . | |
| 4,137,356 | | 1/1979 | Shoemaker et al. | 428/211 |
| 4,457,032 | | 7/1984 | Clarke . | |
| 5,047,267 | | 9/1991 | Pantaleo et al. | 428/13 |
| 5,111,544 | * | 5/1992 | Graebe | 5/490 X |
| 5,125,121 | | 6/1992 | Wroble . | |
| 5,388,295 | | 2/1995 | Sarkozi . | |
| 5,429,852 | | 7/1995 | Quinn . | |
| 5,465,441 | | 11/1995 | Chun . | |
| 5,601,900 | * | 2/1997 | Doscher | 428/134 |
| 5,621,931 | | 4/1997 | Hamilton . | |
| 5,634,223 | | 6/1997 | Obermaier | 5/925 X |
| 5,809,595 | | 9/1998 | Stevens et al. | 5/925 X |
| 5,896,603 | * | 4/1999 | Cooper | 5/653 |
| 5,906,878 | * | 5/1999 | Horning et al. | 297/219.1 X |
| 6,022,617 | * | 2/2000 | Calkins | 297/219.1 X |

* cited by examiner

*Primary Examiner*—Michael F. Tretttel
(74) *Attorney, Agent, or Firm*—Robert L. Epstein; Harold James; James & Franklin, LLP

(57) ABSTRACT

Chair cushions and placemats are formed of a top fabric panel attached to a bottom panel which as a high coefficient of friction. The bottom panel is a rubberized web with an open pattern. The pattern consists of a plurality of rows of parallel, spaced, side by side, relatively small size elongated openings extending in a first direction. A plurality of columns of collinear, spaced, relatively large size elongated openings extend in a second direction. The first and second directions are orthogonal. A plurality of rows of rectangular areas, some of which of are devoid of openings, also form a part of the pattern.

10 Claims, 4 Drawing Sheets

FIG. 3
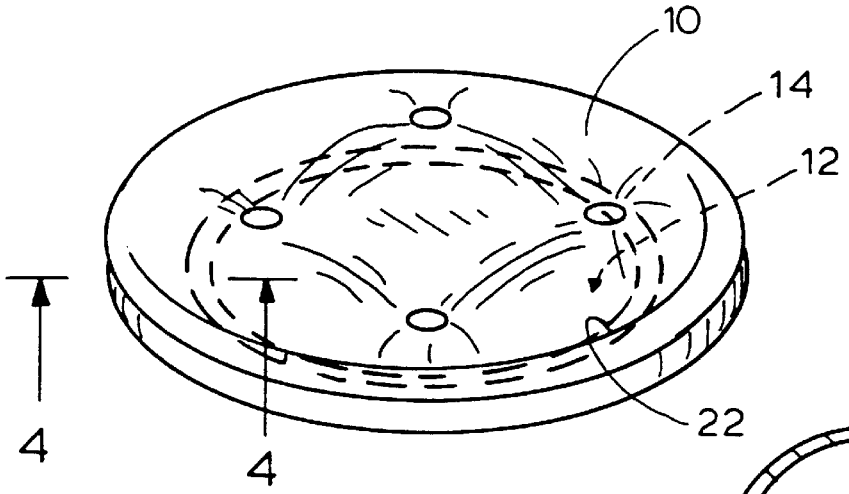
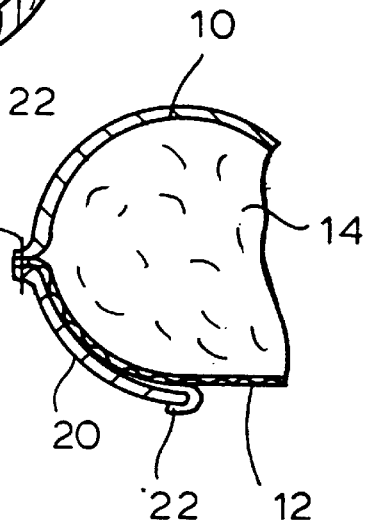
FIG. 4
FIG. 5
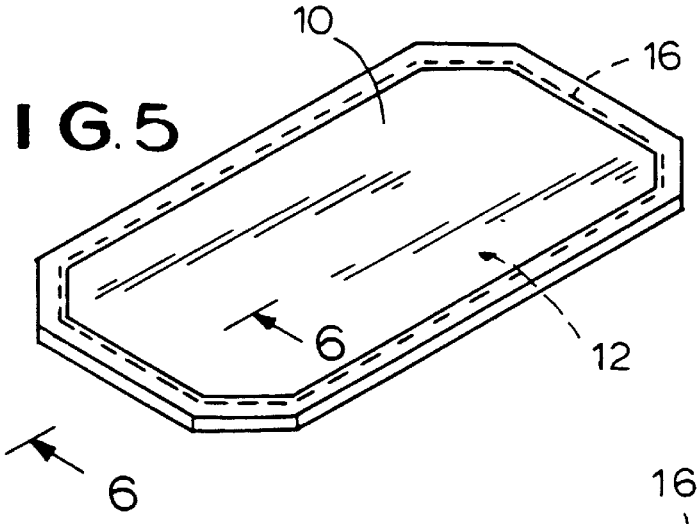
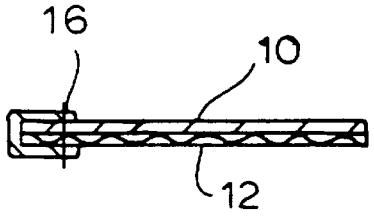
FIG. 6

FIG. 8
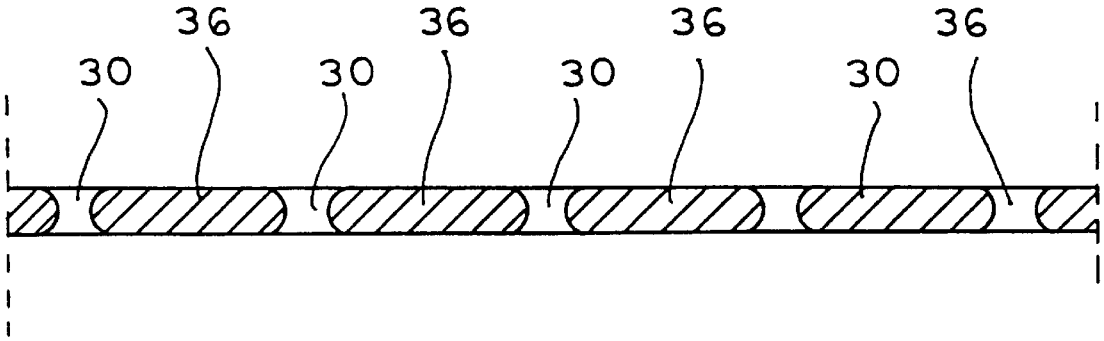
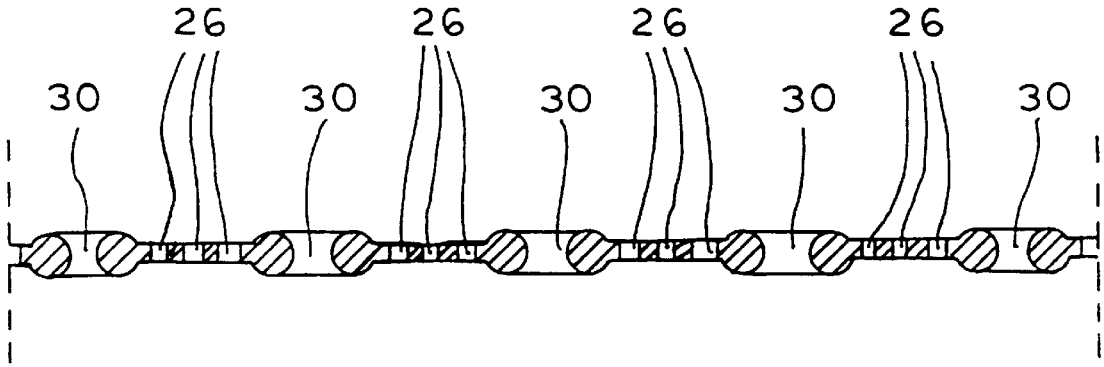
FIG. 9

ARTICLES WITH GRIPPING SURFACES

This application is a continuation-in-part of application Ser. No. 08/993,602, filed Dec. 18, 1997 now U.S. Pat. No. 5,896,603.

This invention relates to household articles with gripping surfaces and more particularly to cushions for chairs and stools as well as placemats and more particularly, to such articles which include a top fabric panel and a bottom panel, where the bottom panel has a high coefficient of friction surface in the form of a rubberized web with an open mesh pattern.

One problem with a variety of a household articles is that they are used on surfaces which are smooth and the articles tend to slip relative to the surface. This is particularly true of chair cushions, which tend to slide along the chair seat as they are being sat upon and placemats which may move along a table or counter as plates or other objects are placed on them.

With regard to chair cushions, string ties are conventionally used to anchor the cushion to the chair. For stools with round seats, an inwardly extending elastic rim may be used to overlap the edges of the seat to secure the cushion.

There have been suggestions in the art that a rubber grip material be used in combination with or be made a part of a cushion. For example, the design patent to Morin, Des. 360,794, issued Aug. 1, 1995 shows a combined child cushion and rubber grip pad unit. U.S. Pat. No. 4,457,032 entitled "Seat Cushion" issued to Clarke on Jul. 3, 1984, discloses a cushion having a lower layer which has a high coefficient of friction. U.S. Pat. No. 5,429,852 entitled "Transportable Chair Pad" issued to Quinn on Jul. 4, 1995 shows a plurality of aeration holes. The bottom layer has a high coefficient of friction.

Rubberized web material with an open mesh pattern is commercially available in sheet form. It is used for variety of different applications, including as non-slip padding under rugs and carpets. The sheets have an irregular surface texture which adds to the characteristics of the rubberized material from which it is made to create a very high coefficient of friction surface.

At the same time, the web material has a open mesh design which permits air to pass through readily. It is highly compressible but has sufficient structural integrity to permit it to be sewn to fabric without tearing. These features, as well as low price and ease of handling, make this web material ideal for use as gripping surface for articles such as chair cushions and placemats.

It is, therefore, a prime object of the present invention to provide improved articles with gripping surfaces which employ high co-efficient of friction rubberized web bottom panels with an open mesh pattern.

It is another object of object of the present invention to provide improved articles with gripping surfaces formed of commercially available rubberized web material which has sufficient structural integrity to be sewn or otherwise affixed to a fabric panel.

It is another object of the present invention to provide improved articles with gripping surfaces are relatively inexpensive to manufacture using commercially available materials and standard fabrication equipment, but which will function reliably for a long useful life.

In accordance with one aspect of the present invention, a cushion is provided including a top fabric panel and a bottom panel of high coefficient of friction material, having an edge. A layer of resilient material is interposed between the panels. Means attach the top panel and the edge of the bottom panel to enclose the resilient layer. The bottom panel is a rubberized web with an open mesh pattern. The pattern is formed of a plurality of a plurality of rows of parallel spaced, side by side, relatively small size openings extending in a first direction. A plurality of columns of collinear, spaced, relatively larger size elongated openings extend in a second direction.

The first and second directions are preferably orthogonal.

A plurality of rows of rectangular areas are formed. Some of the rectangular areas are substantially devoid of openings.

The resilient layer may comprise a foam layer. It may also include any material suitable as fill for a cushion, which may be enclosed in a fabric cover.

The cushion may be designed for use on the seat of a stool. In this case, the top fabric panel is formed so that it extends beyond the attaching means, inwardly along the bottom panel. Elastic means are situated along the edge of the top panel so as to define a recess for receiving the seat of the stool.

The top panel may also include a skirt. The skirt may extend outwardly beyond the attaching means.

In accordance with another aspect of the present invention, a placemat is provided comprising a top fabric panel and a bottom panel of high coefficient of friction material, having an edge. Means attach the top panel and the edge of the bottom-panel. The bottom panel is a rubberized web with an open mesh pattern. The pattern is formed of plurality of rows of parallel spaced, side by side, relatively small size elongated openings extending in a first direction. A plurality of columns of collinear, spaced, relatively larger size openings extend in a second direction.

The first and second directions are preferably orthogonal.

A plurality of rectangular areas are formed. Some of the rectangular areas are substantially devoid of openings.

To these and to such other objects which may hereinafter appear, the present invention relates to improved articles with gripping surfaces, as set forth in detail in the following specification and recited in the annexed claims, taken together with the accompanying drawings, wherein like numerals refer to like parts and in which:

FIG. 3 is a perspective view of a third preferred embodiment of the present invention in the form of a generally circular stool cushion;

FIG. 4 is a cross-sectional view taken along line 4—4 of FIG. 3.

FIG. 5 is a perspective view of a fourth preferred embodiment of the present invention in the form of a placemat.

FIG. 6 is a cross-sectional view taken along line 6—6 of FIG. 5;

FIG. 8 is a cross-sectional view taken along line 8—8 of FIG. 7; and FIG. 9 is a cross-sectional view taken along line 9—9 of FIG. 7.

Figure 1:
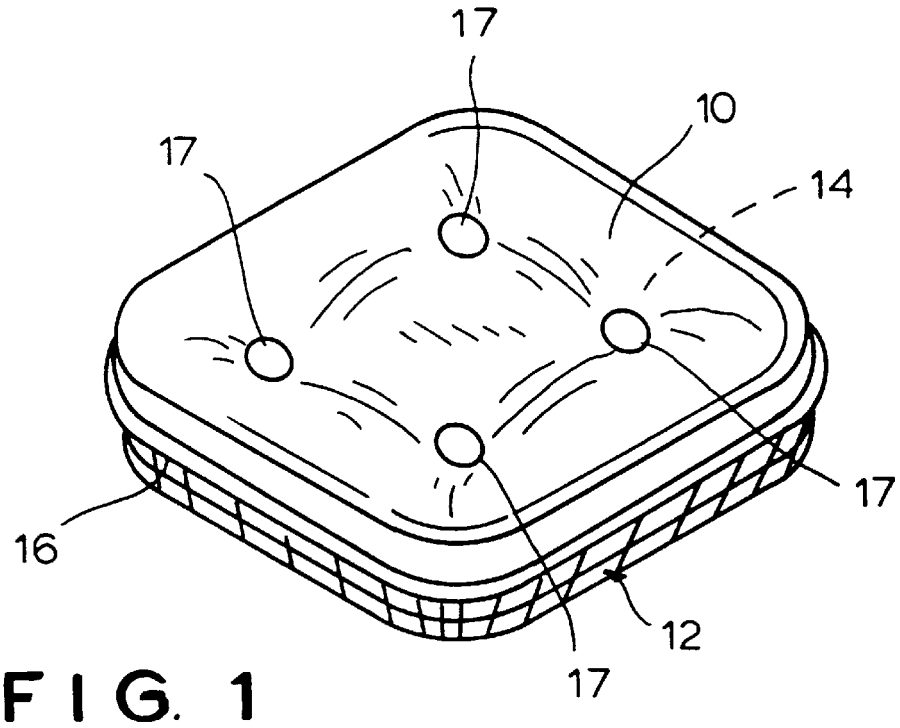
FIG. 1 is a perspective view of a first preferred embodiment of the present invention in the form of a generally rectangular tufted chair cushion.
Figure 2:
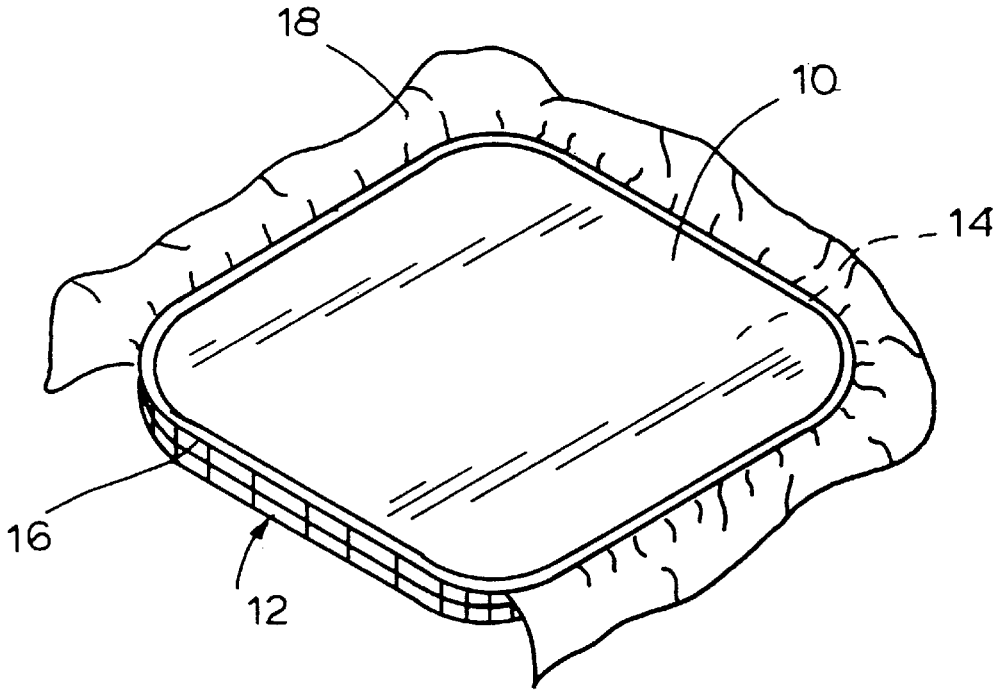
FIG. 2 is a perspective view of a second preferred embodiment of the present invention in the form of a generally rectangular skirted chair cushion.

The invention can be employed in any style of chair cushion. FIG. 1 shows the invention embodied as a tufted chair cushion. FIG. 2 shows the invention embodied as a chair cushion with an outwardly extending skirt. FIG. 3 shows the invention embodied in a stool cushion. In each case, the cushion consists of a top panel 10 composed of any suitable fabric material, including vinyl or plastic, and a bottom panel 12. Bottom panel 12 is composed of a cut to size sheet of commercially available material with a high coefficient of friction and irregular surface texture which prevents the cushion from sliding along the seat of a chair or stool.

Sandwiched between top panel 10 and bottom panel 12 is a layer of resilient material 14. Material 14 may be foam. However, any suitable cushion filler, enclosed in a cover, can be employed. The edge of bottom panel 12 is sewn to top panel 10 by stitches 16, so as to enclose the resilient layer.

In the first embodiment, the panels are additionally sewn together, in a circular pattern, through the resilient layer, at spaced locations, to form tufts 17. In the second embodiment, the top panel 10 extends outwardly beyond stitches 16 on three sides to form a skirt 18. In the third embodiment, a third panel 20 extends from stitch line 16 inwardly, along the bottom panel 12, ending in a rim 22. Rim 22 is provided with an elastic strip. In this way, a expandable recess is formed between panel 20 and bottom panel 12 for receiving the seat of a stool.

FIGS. 5 and 6 show a placemat constructed in accordance with the present invention. Like the cushion, it has a fabric top panel 10 and a high coefficient of friction bottom panel 12 sewn together around the periphery by stitches 16. Unlike the cushions, it has no resilient layer situated between the panels.

Figure 7:
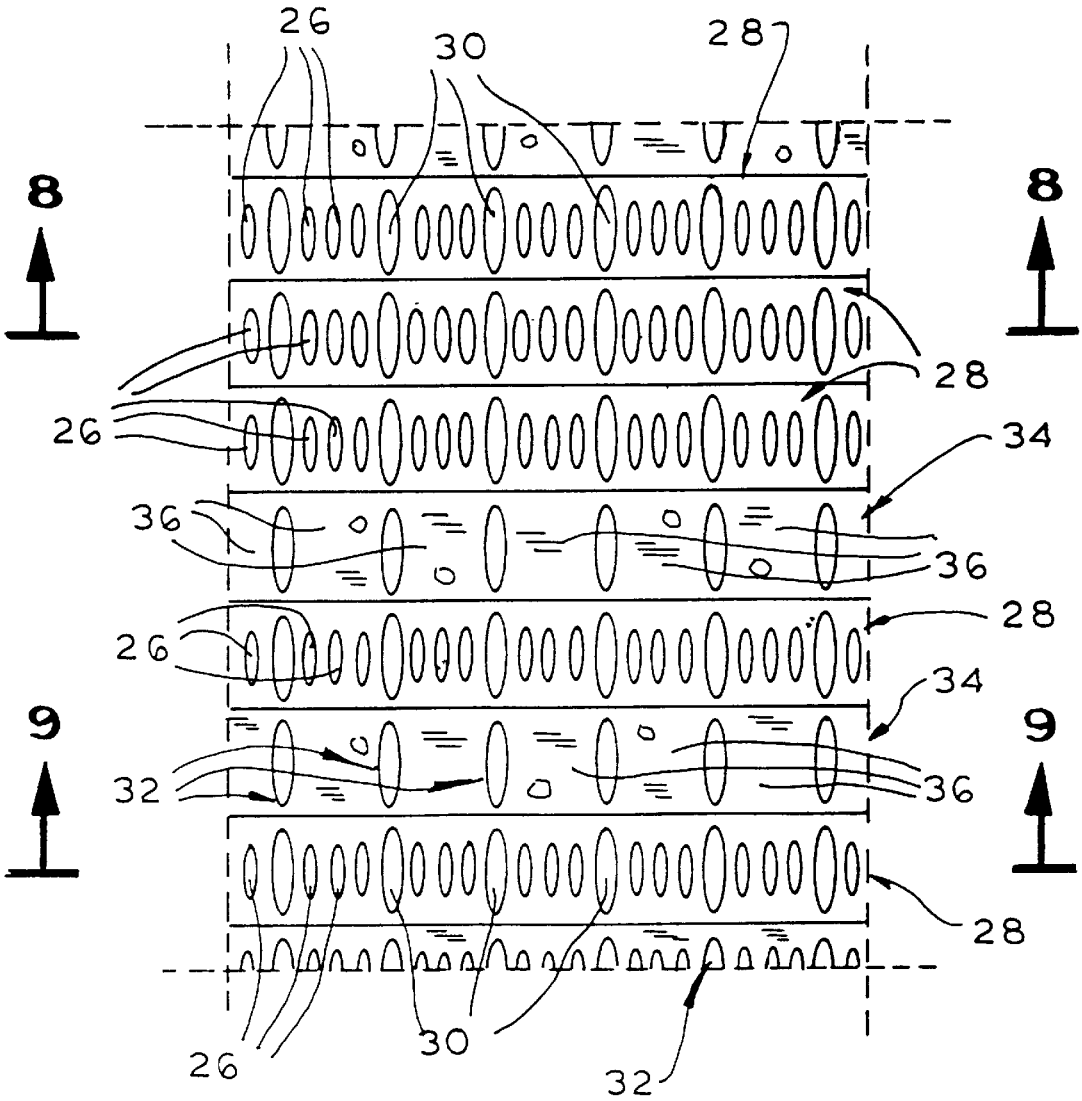
FIG. 7 is an enlarged fragmentary plan view of portion of a typical bottom panel showing the structure of a rubberized web.

The structure of the commercially available rubberized web can best be seen in FIGS. 7, 8 and 9. In describing the web pattern the terms "rows" and "columns" are used to describe features which extend in a vertical and in a horizontal direction, respectively, as seen in the drawings. However, it should be understood that the orientation of the web relative to the remainder of the article is not critical. Accordingly, this nomenclature has been selected as a convenient way to describe features which extend in orthogonal directions and is not intended as a limitation on the invention.

As seen in FIGS. 7, 8 and 9, the web consists of a plurality of parallel, spaced, side by side, relatively small size elongated openings 26. Openings 26 extend in a first direction (horizontal, as seen in the drawings) forming a plurality of rows 28.

A plurality of collinear spaced, relatively larger size elongated openings 30 are provided. Openings 30 extend in a second direction (vertical, as seen in the drawings) forming a plurality of columns 32.

The first direction and the second direction are substantially orthogonal. Hence, rows 28 and columns 32 extend in perpendicular directions.

A plurality of rows 34 of rectangular areas 36 are formed. Some of the areas 36 are substantially devoid of openings.

Not only does the surface of the rubberized web material itself provide a high coefficient of friction, the irregular surface formed by the rows 28 and columns 32 of elongated openings 26, 30 and the rows of rectangular areas 36 devoid of openings contribute to the gripping ability of the bottom panel.

The rows 28 of side of side, relatively small elongated openings 26 create a great amount of friction in a direction perpendicular to which they extend. Similarly, the columns 32 of collinear relatively larger size elongated openings 30 create a great amount of friction in a direction perpendicular to which they extend. The rows of rectangular areas 36, some of which are substantially devoid of openings, create a high degree of friction enhancing the grip of the material by increasing the surface area of the web. Consequently, this web pattern creates a highly nonskid surface, which will counteract movement in any direction.

It will now be appreciated that the present invention relates to articles such as chair cushions and placemats with gripping bottom surfaces. The bottom surfaces are formed of a rubberized web with an open pattern which has a high coefficient of friction but permits air to pass freely through it. This commercially available material has sufficient structural integrity to permit it to be sewn to the top panel. It is inexpensive and easy to handle, forming a reliable product with a long useful life.

While only a limited number of preferred embodiments have been disclosed for purposes of illustration, it is obvious that many variations and modifications could be made thereto. It is intended to cover all of these variations and modifications which fall within the scope of the present invention, as set forth in the following claims:

I claim:

1. A cushion comprising a top fabric panel and a bottom panel of a high coefficient of friction material having an edge, a layer of resilient material, means for attaching the top panel and said edge of the bottom panel to enclose said resilient layer, said bottom panel comprising a rubberized web with an open mesh pattern forming a plurality of rows of substantially parallel, spaced, side by side, relatively small size elongated openings extending a first direction and a plurality of columns of substantially collinear, spaced, relatively larger size elongated openings extending in a second direction, wherein the cushion is designed for use on the seat of a stool and further comprising a third panel extending inwardly from said attaching means along said bottom panel and elastic means situated along the rim of said third panel, so as to define a recess for receiving the seat of the stool.

2. The cushion of claim 1 wherein said first direction and said second direction are substantially orthogonal.

3. A cushion comprising a top fabric panel and a bottom panel of a high coefficient of friction material having an edge, a layer of resilient material, means for attaching the top panel and said edge of the bottom panel to enclose said resilient layer, said bottom panel comprising a rubberized web with an open mesh pattern forming a plurality of rows of substantially parallel, spaced, side by side, relatively small size elongated openings extending a first direction and a plurality of columns of substantially collinear, spaced, relatively larger size elongated openings extending in a second direction, where said first direction and said second direction are substantially orthogonal and wherein said top panel further comprises a skirt which extends outwardly beyond said attaching means.

4. The cushion of claim 3 wherein a plurality of rows of substantially rectangular areas are formed.

5. The cushion of claim 4 wherein some of said areas are substantially devoid of openings.

6. The cushion of claim 4 wherein said resilient layer comprises a foam layer.

7. A placemat comprising a top fabric panel and bottom panel of high coefficient of friction material, having an edge, means for attaching the top panel and said edge of the bottom panel, said bottom panel comprising a rubberized web with an open mesh pattern formed of a plurality of rows of substantially parallel spaced, side by side, relatively small size elongated openings extending in a first direction and a plurality of columns of substantially collinear, spaced, relatively larger size elongated openings extending in a second direction.

8. The placemat of claim 7 wherein said first direction and said second direction are substantially orthogonal.

9. The placemat of claim 7 wherein a plurality of rows of substantially rectangular areas are formed.

10. The placemat of claim 9 wherein some of said areas are devoid of openings.

* * * * *